US005506084A

United States Patent [19]

Ohta et al.

[11] Patent Number: 5,506,084

[45] Date of Patent: Apr. 9, 1996

[54] MAGNETIC DEVELOPER AND DEVELOPING DEVICE USING SAME

[75] Inventors: Mitsuru Ohta; Naomichi Kobayashi; Noriaki Satoh, all of Nagoya, Japan

[73] Assignee: Brother Kogyo Kabushiki Kaisha, Nagoya, Japan

[21] Appl. No.: 335,963

[22] Filed: Nov. 7, 1994

[30] Foreign Application Priority Data

Dec. 27, 1993 [JP] Japan ..... 5-331540
Dec. 28, 1993 [JP] Japan ..... 5-337339

[51] Int. Cl.[6] ..... G03G 9/083; G03G 9/107; G03G 15/09

[52] U.S. Cl. ..... 430/106.6; 430/110; 430/111; 355/251

[58] Field of Search ..... 430/106.6, 111; 355/251

[56] References Cited

U.S. PATENT DOCUMENTS 3,838,054 9/1974 Trachtenberg et al. ..... 430/106.6
4,436,803 3/1984 Ikeda et al. ..... 430/106.6 X
4,525,447 6/1985 Tanaka et al. ..... 430/106.6 X
4,578,337 3/1986 Oka ..... 430/106.6 X
4,640,880 2/1987 Kawanishi et al. ..... 430/106.6
4,663,262 5/1987 Oka et al. ..... 430/108
4,683,187 7/1987 Goldstein et al. ..... 430/106.6

FOREIGN PATENT DOCUMENTS 0358202 3/1990 European Pat. Off. ..... 430/106.6
60-229037 11/1985 Japan .

*Primary Examiner*—Roland Martin
*Attorney, Agent, or Firm*—Oliff & Berridge

[57] ABSTRACT

An electrostatic latent image developer containing a carrier, a toner, and an electric field adjusting agent. The electric field adjusting agent is formed as particles having an average particle size smaller than that of the carrier, and contains a magnetic powder in a specific amount less than that of a magnetic powder contained in the carrier and greater than that of a magnetic powder contained in the toner. The magnetic powder may be deposited on the surface of each particle of the electric field adjusting agent to form a conductive layer capable of smoothly taking or imparting charges away from or to the toner. Accordingly, an electric field formed in a gap between a developing sleeve and a photosensitive member can be intensified to thereby prevent an edge effect and enhance a permittivity in this gap. Accordingly, the electrostatic latent image formed on the photosensitive member can be faithfully developed.

23 Claims, 2 Drawing Sheets

MAGNETIC DEVELOPER AND DEVELOPING DEVICE USING SAME

BACKGROUND OF THE INVENTION

1. Field of the Invention

The present invention relates to an electrostatic latent image developer and an electrostatic latent image developing method using the same, and more particularly to a novel electrostatic latent image developer applicable to any electrophotographic developing systems such as printers and facsimiles that include development of an electrostatic latent image and also to a developing method using such a developer.

2. Description of the Related Art

Various types of electrophotographic developing systems for developing an electrostatic latent image have conventionally been proposed, and they are generally classified into a one-component developing system and a two-component developing system. The one-component developing system employs a developer containing only a toner for developing an electrostatic latent image formed on a photosensitive member. The one-component developing system has two types, one employing a magnetic toner whereas the other employs a nonmagnetic toner. In both types, a thin developer layer is formed on a support member for supporting the toner. On the other hand, the two-component developing system employs a developer containing 95 to 98 wt % of a carrier and 2 to 5 wt % of a toner mixed together. In this mixing ratio, the toner can uniformly contact the carrier so as to surround it. The toner in this system is a nonmagnetic toner, and if the mixing ratio of the toner is greater than 5 wt %, fog due to the toner occurs in a background portion of a printed image to cause a reduction in image quality.

There has been proposed another system using a magnetic toner as the toner of the developer employed in the two-component developing system to increase the mixing ratio of the toner. This proposed system may be regarded as an intermediate between the one-component developing system and the two-component developing system, and is accordingly called a 1.5-component developing system. The 1.5-component developing system is disclosed in detail in U.S. Pat. No. 4,640,880 (Japanese Patent Publication No. Hei 2-31383), which is incorporated herein by reference. The 1.5-component developing system employs a developer containing 30 to 80 wt % of a carrier and 20 to 70 wt % of a toner mixed together. Also in the 1.5-component developing system, like the two-component developing system, the developer is supported on a developing sleeve incorporating a magnet roll therein to form a developer layer thicker than that in the one-component developing system on the developing sleeve. Accordingly, the 1.5-component developing system has a problem that much fog due to the toner occurs in a background portion of a printed image and additionally the sharpness of lines or letters of the printed image becomes low because of the thick developer layer on the developing sleeve in spite of the low mixing ratio of the carrier.

Further, the bristles of a magnetic brush formed by the developing sleeve and the magnet roll in the 1.5-component developing system are lower in height than those in the two-component developing system. Accordingly, the 1.5-component developing system has an advantage in that a gap between the photosensitive member and the developing sleeve can be made narrower than that in the two-component developing system owing to the reduced height of the bristles of the magnetic brush, thereby effecting faithful development by an electric field generated in the gap between the photosensitive member and the developing sleeve. However, in the 1.5-component developing system, the reproductivity of fine lines is not satisfactory. For example, although the diameter of a dot formed by a laser beam is about 80 μm, the thickness of a line becomes 100 to 150 μm. Accordingly, even when an image having lines spaced a distance corresponding to the dot diameter is printed, the lines printed are joined together, resulting in a defective print similar to a solid image. In addition, such unfaithful reproduction with respect to the dot of the laser beam causes a reduction in clearness of letters due to splash of the toner around the letters.

SUMMARY OF THE INVENTION

It is an object of the present invention to provide an electrostatic latent image developer for use in a developing system for developing an electrostatic latent image which developer can effectively suppress fog in a background portion of a printed image.

It is another object of the present invention to provide such an electrostatic latent image developer which can faithfully develop an electrostatic latent image formed on a photosensitive member to thereby improve the sharpness of lines and letters of the printed image.

It is still another object of the present invention to provide an electrostatic latent image developing method which can effectively develop an electrostatic latent image formed on a photosensitive member by using such a developer.

According to an aspect of the present invention, there is provided an electrostatic latent image developer comprising a carrier composed substantially of a magnetic powder and having an average particle size of 20 to 100 μm, a toner containing a magnetic powder in an amount of 35 to 55 wt % and having an average particle size of 5 to 15 μm, and an electric field adjusting agent containing at least a magnetic powder and a binder resin, a content of the magnetic powder in the electric field adjusting agent being set within a range of 60 to 85 wt %, an average particle size of the electric field adjusting agent being set within a range of 5 to 30 μm and smaller than the average particle size of the carrier, a part of the magnetic powder contained in the electric field adjusting agent being deposited on the surfaces of particles of the electric field adjusting agent so as to cover the surfaces of the particles. The electric field adjusting agent functions to render triboelectric charging of the toner uniform. Preferably, the volume resistivity of the electric field adjusting agent is $8\times10^8$ Ωcm or less, so that the triboelectric charging of the toner can be made more uniform.

According to another aspect of the present invention, there is provided an electrostatic latent image developing method comprising the steps of supplying an electrostatic latent image developer stored in a developer storing chamber to a surface of a developing sleeve by magnetic attraction, forming an electrostatic latent image on a surface of a photosensitive member, and carrying the developer supported on the developing sleeve to the photosensitive member to develop the electrostatic latent image with the developer; wherein the electrostatic latent image developer comprises a carrier composed substantially of a magnetic powder and having an average particle size of 20 to 100 μm, a toner containing a magnetic powder in an amount of 35 to 55 wt % and having an average particle size of 5 to 15 μm, and an electric field adjusting agent containing at least a magnetic powder and a binder resin, a content of the magnetic powder in the electric field adjusting agent being set within a range of 60 to 85 wt %, an average particle size of the electric field adjusting agent being set within a range of 5 to 30 μm and smaller than the average particle size of the carrier, a part of the magnetic powder contained in the electric field adjusting agent being deposited on the surfaces of particles of the electric field adjusting agent so as to cover the surfaces of the particles; and the toner is newly supplied into the developer storing chamber according to a consumption of the toner contained in the developer in concert with proceeding of development by the use of the developer.

According to still another aspect of the present invention, there is provided an electrostatic latent image developing method comprising the steps of supplying an electrostatic latent image developer stored in a developer storing chamber to a surface of a developing sleeve by magnetic attraction, forming an electrostatic latent image on a surface of a photosensitive member, and carrying the developer supported on the developing sleeve to the photosensitive member to develop the electrostatic latent image with the developer; wherein the electrostatic latent image developer comprises a carrier composed substantially of a magnetic powder and having an average particle size of 20 to 100 μm, a toner containing a magnetic powder in an amount of 35 to 55 wt % and having an average particle size of 5 to 15 μm, and an electric field adjusting agent containing at least a magnetic powder and a binder resin, a content of the magnetic powder in the electric field adjusting agent being set within a range of 60 to 85 wt %, an average particle size of the electric field adjusting agent being set within a range of 5 to 30 μm and smaller than the average particle size of the carrier, a part of the magnetic powder contained in the electric field adjusting agent being deposited on the surfaces of particles of the electric field adjusting agent so as to cover the surfaces of the particles; and a mixture of the toner and the electric field adjusting agent is newly supplied into the developer storing chamber according to consumption of the toner and the electric field adjusting agent contained in the developer in concert with proceeding of development by the use of the developer.

As described above, the electrostatic latent image developer contains a carrier, a toner, and an electric field adjusting agent. The electric field adjusting agent is formed as particles having an average particle size smaller than that of the carrier, and contains a magnetic powder in a specific amount less than that of a magnetic powder contained in the carrier and greater than that of a magnetic powder contained in the toner. The magnetic powder contained in the electric field adjusting agent may be deposited on a surface of each particle of the electric field adjusting agent so as to substantially cover the surface of each particle. Owing to the presence of the electric field adjusting agent in the developer, the amount of charges on the toner can be made uniform.

In general, the toner and the carrier come into frictional contact with each other to impart triboelectric charges to the toner. If the electric field adjusting agent is absent in the developer, the amount of charges on the toner depends on the frequency of frictional contact between the toner and the carrier. In this frictional contact, some particles of the toner take a high amount of charges, and some particles of the toner take a low amount of charges. Accordingly, there arises a large variation in the amount of charges on the toner. By mixing the electric field adjusting agent in the developer, the electric field adjusting agent functions to take the charges away from the toner particles having a high amount of charges and impart the charges to the toner particles having a low amount of charges. That is, the electric field adjusting agent itself can be charged not only positively but also negatively, or can be neutralized to thereby control the amount of charges on the toner and maintain a reference amount of charges on the toner, thereby effectively contributing to faithful development of the electrostatic latent image formed on the photosensitive member.

Further, an electric field is formed in a gap between the developing sleeve as a support member for the developer and the photosensitive member as a support member for the electrostatic latent image. The toner in the developer supported on the developing sleeve is deposited onto the photosensitive member for development by an electric field between a development potential applied to the developing sleeve and a surface potential of the electrostatic latent image on the photosensitive member. The magnetic powder deposited on the surface of each particle of the electric field adjusting agent forms a conductive layer capable of smoothly taking or imparting the charges away from or to the toner. Accordingly, the electric field adjusting agent contained in the developer present in the gap between the developing sleeve and the photosensitive member operates to intensify the electric field formed in this gap, thereby preventing an edge effect due to an electric field applied in the electrostatic latent image and enhancing a permittivity in the gap between the developing sleeve and the photosensitive member. Accordingly, the toner in the developer present in the gap between the developing sleeve and the photosensitive member with an increased permittivity can be faithfully deposited onto the electrostatic latent image formed on the photosensitive member, thus realizing faithful development of the electrostatic latent image.

As apparent from the above description, the electrostatic latent image developer according to the present invention contains the specific electric field adjusting agent in addition to the carrier and the toner, and the development of the electrostatic latent image is performed by using such a developer. The presence of the electric field adjusting agent in the developer brings about the advantages that fog in a background portion of a printed image can be effectively suppressed, and the toner can be faithfully deposited onto the electrostatic latent image formed on the photosensitive member, thereby effectively improving the sharpness of letters or lines of the printed image.

BRIEF DESCRIPTION OF THE DRAWINGS

A preferred embodiment of the present invention will be described in detail with reference to the following figures, wherein.

DETAILED DESCRIPTION OF PREFERRED EMBODIMENTS

Figure 1:
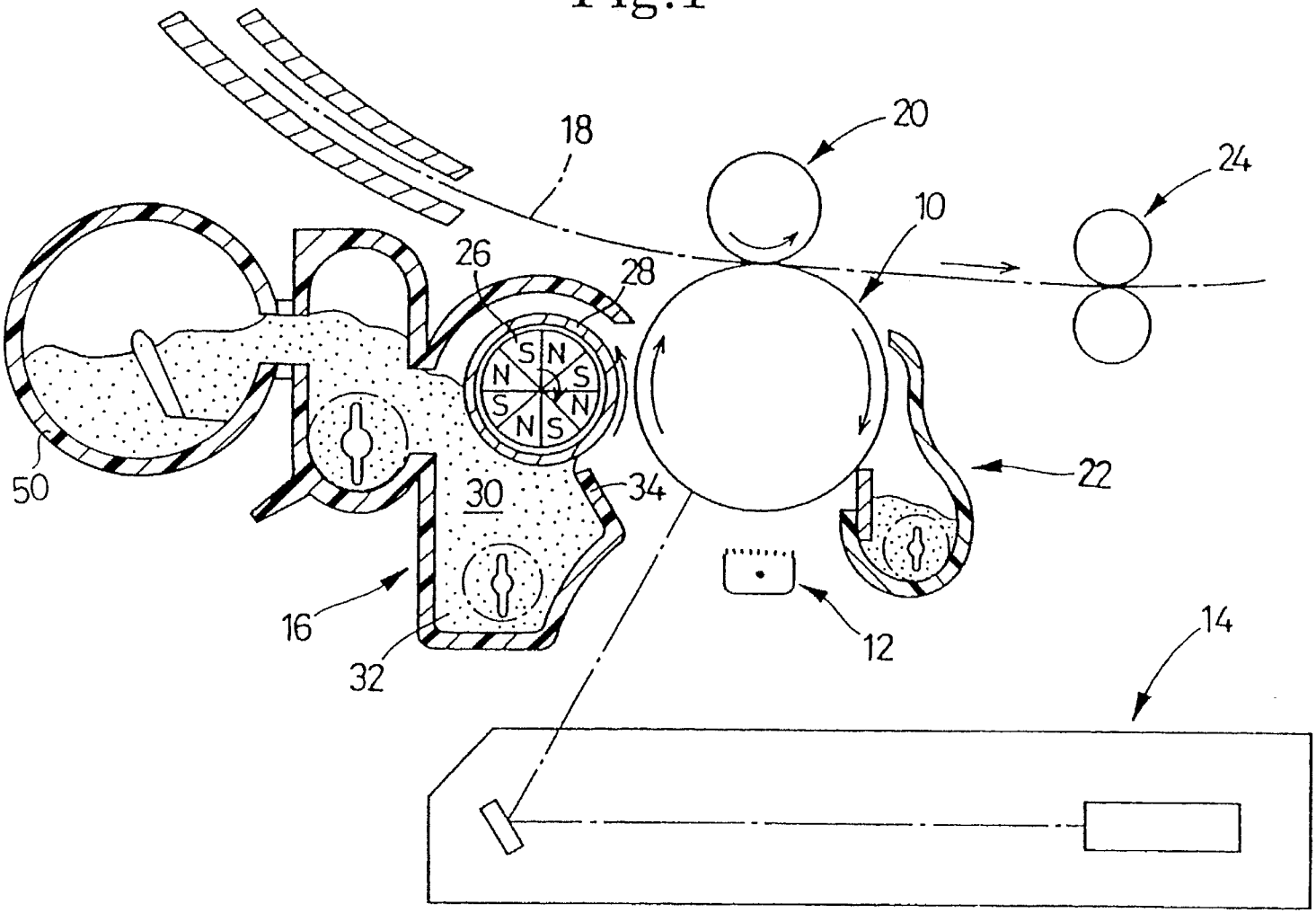
FIG. 1 is a view illustrating the construction of an essential part of a laser beam printer to which the electrostatic latent image developer according to the present invention may be applied.

The electrostatic latent image developer of the present invention is formed by mixing a specific carrier, toner, and electric field adjusting agent in a predetermined ratio. The mixing ratio of these components may be set generally to carrier:toner:electric field adjusting agent=10 to 80 wt %:10 to 55 wt %:5 to 60 wt %, preferably to carrier:toner:electric field adjusting agent=50 to 80 wt %:10 to 40 wt %:5 to 40 wt % (with the proviso that the total amount of the carrier, the toner, and the electric field adjusting agent is 100 wt %).

If the content of the carrier in the electrostatic latent image developer is less than 10 wt %, the frequency of contact of the carrier with the toner decreases to cause no triboelectric charging of the toner, resulting in nonuniformity of the amount of charges on the toner. If the content of the carrier in the electrostatic latent image developer is greater than 80 wt %, supplementation of the toner delays in the case where the toner consumption for development of an electrostatic latent image become large, causing a reduction in black density of a developed image.

If the content of the toner in the electrostatic latent image developer is less than 10 wt %, supplementation of the toner delays in the case where the toner consumption for development of an electrostatic latent image become large, causing a reduction in black density of a developed image. If the content of the toner in the electrostatic latent image developer is greater than 55 wt %, the frequency of contact of the toner with the carrier decreases to cause insufficiency of charging, resulting in an increase in fog and splash in a developed image.

If the content of the electric field adjusting agent in the electrostatic latent image developer is less than 5 wt %, the effect of this agent is not sufficiently exhibited and the improvement in image quality cannot therefore be expected. If the content of the electric field adjusting agent in the electrostatic latent image developer is greater than 60 wt %, this agent itself is charged like the toner in addition to the original function of controlling the charging of the toner, so that the agent thus charged is also deposited to a photosensitive member, causing nonuniformity of the charging of the toner to result in an increase in fog and nonuniformity in black density.

The carrier constituting the electrostatic latent image developer according to the present invention can, for example, be a hard carrier. That is, the carrier is formed as generally spherical particles each composed substantially of magnetic powder. Preferably, the carrier is a carrier core material formed of magnetic powder or such a material coated with a suitable resin. The magnetic powder forming the carrier core material may be formed from any magnetic powder such as iron, nickel, cobalt, ferrite, etc. or a mixture obtained by mixing such magnetic powders in a suitable ratio as required. With use of such magnetic powders as a raw material, the carrier core material may be manufactured by temporarily burning the mixture of the magnetic powders, grinding it to an average particle size of 2 μm or less, granulating it to a predetermined particle size, firing it at 1,250° to 1,350° C. for 3 to 5 hours, and cracking or classifying it to obtain substantially spherical particles having an average particle size of 20 to 100 μm, preferably 40 to 60 μm (the average particle size referred herein and to be referred hereafter means a weight average particle size). The carrier core material thus obtained may be used as it is or with a suitable resin coating for the carrier. Such a resin coating may be formed of, for example, fluorine resin, styrene resin, acrylic resin, silicone resin, epoxy resin, polyester resin, polyalkylene resin, etc. Advantageously, the surface of the carrier core material is coated with such a resin or resins to obtain the desired carrier. The above-mentioned carrier is disclosed in U.S. Pat. No. 4,663,262 (Japanese Patent Publication No. Hei 2-60186), which is incorporated herein by reference.

The toner that is one component of the electrostatic latent image developer according to the present invention may be composed of binder resin, magnetic powder, releasing agent, charge control agent, etc. like a conventional toner. Examples of the binder resin may include polystyrene, polyacrylate, polymethacrylate, vinyl resin, polyester resin, polyethylene, polypropylene, polyvinyl chloride, polyacrylonitrile, polyether, polycarbonate, cellulose resin, polyamide, and copolymer of monomers giving these resins. Preferably, a copolymer of styrene monomer and acrylic monomer is used. The magnetic powder may be formed of any material showing magnetism by itself or any magnetizable material. Examples of such materials may include metals such as iron, manganese, nickel, cobalt, and chromium, and metal oxides such as magnetite, hematite, and ferrite. These materials for the magnetic powder may be used in the form of fine powder. The releasing agent may be formed of polyalkylene such as polyethylene and polypropylene, or natural wax such as carnauba wax, candelilla wax, and rice wax. The charge control agent may include a positively chargeable charge control agent formed of nigrosine dye, quaternary ammonium salt, alkoxylated amine, alkyl amide, or the like, and a negatively chargeable charge control agent formed of metal complex of azo dye, metal salt of higher fatty acid, or the like.

The content of the magnetic powder in the toner is preferably within the range of 35 to 55 wt %. If the content of the magnetic powder in the toner is greater than 55 wt %, a magnetic restraint of the toner to a developing sleeve becomes large, and an image having a sufficient density cannot be obtained unless a rotational speed of the developing sleeve or a gap between the developing sleeve and the photosensitive member is extremely adjusted. If the content of the magnetic powder in the toner is less than 35 wt %, the magnetic restraint of the toner to the developing sleeve becomes insufficient, and the toner with no charges is deposited to the surface of the photosensitive member, causing fog. The content of the releasing agent in the toner may be set to about 0.5 to 10 wt %; the content of the charge control agent may be set to about 0.1 to 5 wt %; and the content of the binder resin may be set as a residual content.

Preferably, the average particle size of the toner is within the range of 5 to 15 μm. If the average particle size of the toner is less than 5 μm, handling of the toner in the form of fine powder is difficult, and the fluidity of the toner is reduced to cause difficulty in uniform triboelectric charging. If the average particle size of the toner is greater than 15 μm, the resolution of a developed image is reduced, and it is difficult to obtain a resolution of 300 dpi, which is general in current printers.

According to the present invention, the electric field adjusting agent having an average particle size smaller than that of the carrier and containing magnetic powder in an amount larger than that of the toner is mixed with a developer obtained by mixing the carrier and the toner. The electric field adjusting agent contains at least magnetic powder and binder resin, wherein the magnetic powder is contained in each particle formed by the binder resin, and the magnetic powder is deposited on the particle so as to cover substantially the entire surface of the particle. That is, a conductive layer of the magnetic powder is formed on the surface of the particle. Thus, the mixing of the electric field adjusting agent can provide an intended effect.

The electric field adjusting agent may be manufactured by a process similar to that of manufacturing the toner mentioned above. Specifically, the binder resin and the magnetic powder are first mixed uniformly in the form of powder, and as required, a releasing agent (wax) and a charge control agent are added and mixed together in the form of powder. These components to be mixed are selected from those used in preparing the toner mentioned above. The releasing agent and the charge control agent are not essential components but optional components to be mixed as required. However, addition of the releasing agent provides an advantage such that a load applied to the electric field adjusting agent in a developing unit can be relaxed. Further, addition of the charge control agent provides an advantage such that the chargeability of the electric field adjusting agent to the carrier can be clearly distinguished from that to the toner.

In the case where the volume resistivity of the electric field adjusting agent becomes greater than $8\times10^8$ Ωcm, a conductive material may be mixed to reduce the volume resistivity. Examples of the conductive material may include titanium oxide, metal powder such as nickel, cobalt, manganese, and iron, and organic conductive material such as carbon black.

Then, the uniform mixture containing at least the binder resin and the magnetic powder is melted and kneaded to form a mixed bulk. Thereafter, the mixed bulk is coarsely ground and then finely ground. Thereafter, the mixed bulk thus ground is classified to obtain the electric field adjusting agent having a predetermined average particle size. In the electric field adjusting agent thus obtained by grinding and classifying the mixed bulk containing the magnetic powder in a large proportion, the magnetic powder mixed is preferably deposited to the surface of each particle of the electric field adjusting agent so as to cover substantially the entire surface of the particle and form the conductive layer of the magnetic powder; however, this mechanism is not known.

Preferably, the mixing ratio of the binder resin and the magnetic powder is set to binder resin:magnetic powder=15 to 40 wt %:60 to 85 wt %. If the content of the magnetic powder in the electric field adjusting agent is less than 60 wt %, a sufficient volume resistivity cannot be obtained and the proportion of deposition of the magnetic powder to the surface of the electric field adjusting agent is reduced to weaken the effect of the electric field adjusting agent such that the intensity of an electric field formed between the developing sleeve and the photosensitive member is not enhanced. If the content of the magnetic powder in the electric field adjusting agent is greater than 85 wt %, the hot mixture of the binder resin and the magnetic powder cannot be formed in a bulk state and it is therefore difficult to obtain the particles of the electric field adjusting agent. On the other hand, if the content of the binder resin in the electric field adjusting agent is less than 15 wt %, the binder resin cannot surround the magnetic powder and therefore cannot form the particles. If the content of the binder resin in the electric field adjusting agent is greater than 40 wt %, the sufficient conductive effect of the electric field adjusting agent is weakened and the volume resistivity cannot be reduced to $8\times10^8$ Ωcm or less even by addition of not only the magnetic powder but also the conductive material.

The average particle size of the electric field adjusting agent may be preferably set within the range of 5 to 30 μm, preferably 8 to 15 μm. If the average particle size of the electric field adjusting agent is greater than 30 μm, the particle size distribution is spread to cause a reduction in image quality. If the average particle size of the electric field adjusting agent is less than 5 μm, some particles not containing the magnetic powder are created and it is therefore difficult to sufficiently exhibit the effect of addition of the electric field adjusting agent.

The above-mentioned volume resistivity is measured with use of a dielectric loss measuring instrument (TR-10C made by Ando Electric Co., Ltd.) by calculation from a conductivity upon application of an alternating current potential of 10 V with a frequency of 1 kHz to the electric field adjusting agent in the form of pellet.

In mixing the carrier, the toner, and the electric field adjusting agent to manufacture the electrostatic latent image developer according to the present invention, various known mixing methods or addition methods may be suitably used. For example, the carrier, the toner, and the electric field adjusting agent may be mixed together simultaneously or sequentially. Further, two of these three components may be first mixed together, and the mixture thus preliminarily formed may be mixed with the residual component.

The electrostatic latent image developer according to the present invention is charged into various apparatus using an electrophotographic developing system and is applied to a printing method including development of an electrostatic latent image. The principle of development will now be described with reference to FIG. 1 showing a specific embodiment where the developer according to the present invention is charged into a laser beam printer.

The laser beam printer shown in FIG. 1 is equipped with an electrophotographic developing system including a photosensitive member 10 formed by applying a photoconductive layer on a conductive cylinder such as aluminum, a charging unit 12 for providing a surface potential onto the photosensitive member 10, a scanner 14 that is preferably a laser scanner for providing image information onto the photosensitive member 10, a developing unit 16 for developing an electrostatic latent image formed on the photosensitive member 10 to form a toner image, a transferring unit 20 for transferring the developed toner image formed on the photosensitive member 10 to a recording medium 18 such as a sheet of paper, and a cleaning unit 22 for removing an excess toner that has not been transferred by the transferring unit 20 and is left on the photosensitive member 10. All of the elements 12, 14, 16, 20, and 22 are located around the photosensitive member 10. Further, a heat fixing device 24 is provided to heat and melt the toner image transferred onto the recording medium 18 and thereby fix the toner image.

In the developing unit 16, a nonmagnetic developing sleeve 28 is located around a magnet roll 26 in such a manner that they are rotatable relative to each other in opposite directions. The direction of rotation of the developing sleeve 28 is opposite to the direction of rotation of the photosensitive member 10. An electrostatic latent image developer 30 according to the present invention is contained in a developer container of the developing unit 16. The developer 30 is agitated by suitable agitating means to come into contact with the developing sleeve 28. The developing sleeve 28 must be rotated in order to carry the developer 30, but the rotation of the magnet roll 26 is not essential. That is, the magnet roll 26 may be kept at rest.

More specifically, the developer 30 may be stored in a chamber in which the developing sleeve 28 is disposed. This chamber will be referred to as a carrier confining chamber 32. Prior to starting development, the preliminarily mixed developer, i.e., the mixture of at least the carrier, the toner, and the electric field adjusting agent, as the electrostatic latent image developer according to the present invention, is charged into the carrier confining chamber 32. The carrier contained in the developer 30 is inhibited from being present in or moving to an area except the carrier confining chamber 32 and the surface of the developing sleeve 28. Although the carrier present on the surface of the developing sleeve 28 is carried to the photosensitive member 10, the carrier is not deposited to the photosensitive member 10. However, the toner carried by the developing sleeve 28 to the photosensitive member 10 is deposited to the photosensitive member 10 and is therefore consumed. Further, in some cases, the electric field adjusting agent carried by the developing sleeve 28 to the photosensitive member 10 is also deposited with the toner to the photosensitive member 10 for the following reason. That is, the toner is charged by frictional contact with the carrier. The electric field adjusting agent interposed between the carrier and the toner functions to render uniform the amount of charges on the toner. Further, since the electric field adjusting agent interposed between the carrier and the toner frictionally contacting each other has a certain conductivity, the agent is also charged to some degree, although not high like the toner. As a result, there is a possibility that the electric field adjusting agent itself is also deposited to the photosensitive member 10 and is therefore consumed. Accordingly, the toner only or the mixture of the toner and the electric field adjusting agent is supplemented in the carrier confining chamber 32 from a toner box 50 communicating therewith according to the consumption of the toner or the electric field adjusting agent with the toner.

In the developing unit 16, the developer 30 is in contact with the developing sleeve 28, and accordingly there is present on the developing sleeve 28 a developer layer of the mixture containing at least the carrier, the toner, and the electric field adjusting agent. In order to render the thickness of the developer layer to be formed on the developing sleeve 28 substantially uniform, a blade 34 is provided so as to space from the developing sleeve 28 by a distance corresponding to the thickness of the developer layer to be formed uniform on the developing sleeve 28. The distance between the developing sleeve 28 and the blade 34 has an influence on an image quality, and it is generally set smaller than a gap (usually, 250 to 450 μm) between the photosensitive member 10 and the developing sleeve 28. When the gap between the photosensitive member 10 and the developing sleeve 28 is 350 μm, for example, the distance between the blade 34 and the developing sleeve 28 is controlled to fall within the range of 200 to 300 μm.

In the charging unit 12, a voltage of about 3 to 5 kV is applied thereto to perform corona discharge and thereby apply a surface potential of about, for example, +700 V on the photosensitive member 10. Means provided in the charging unit 12 for applying such a surface potential on the photosensitive member 10 may include a scorotron designed to perform corona discharge to apply a predetermined surface potential on the photosensitive member 10, or a semiconductive member such as a semiconductive brush, roller, or blade designed to contact the photosensitive member 10 to apply a predetermined surface potential on the photosensitive member 10.

The image information converted to an electrical signal is supplied as an optical signal from the laser scanner 14 to the photosensitive member 10, and the surface potential on the photosensitive member 10 at a portion exposed to a laser beam from the laser scanner 14 is reduced by the operation of the photoconductive layer formed on the surface of the photosensitive member 10, thereby forming an electrostatic latent image with different potential distributions on the photosensitive member 10.

Figure 2:
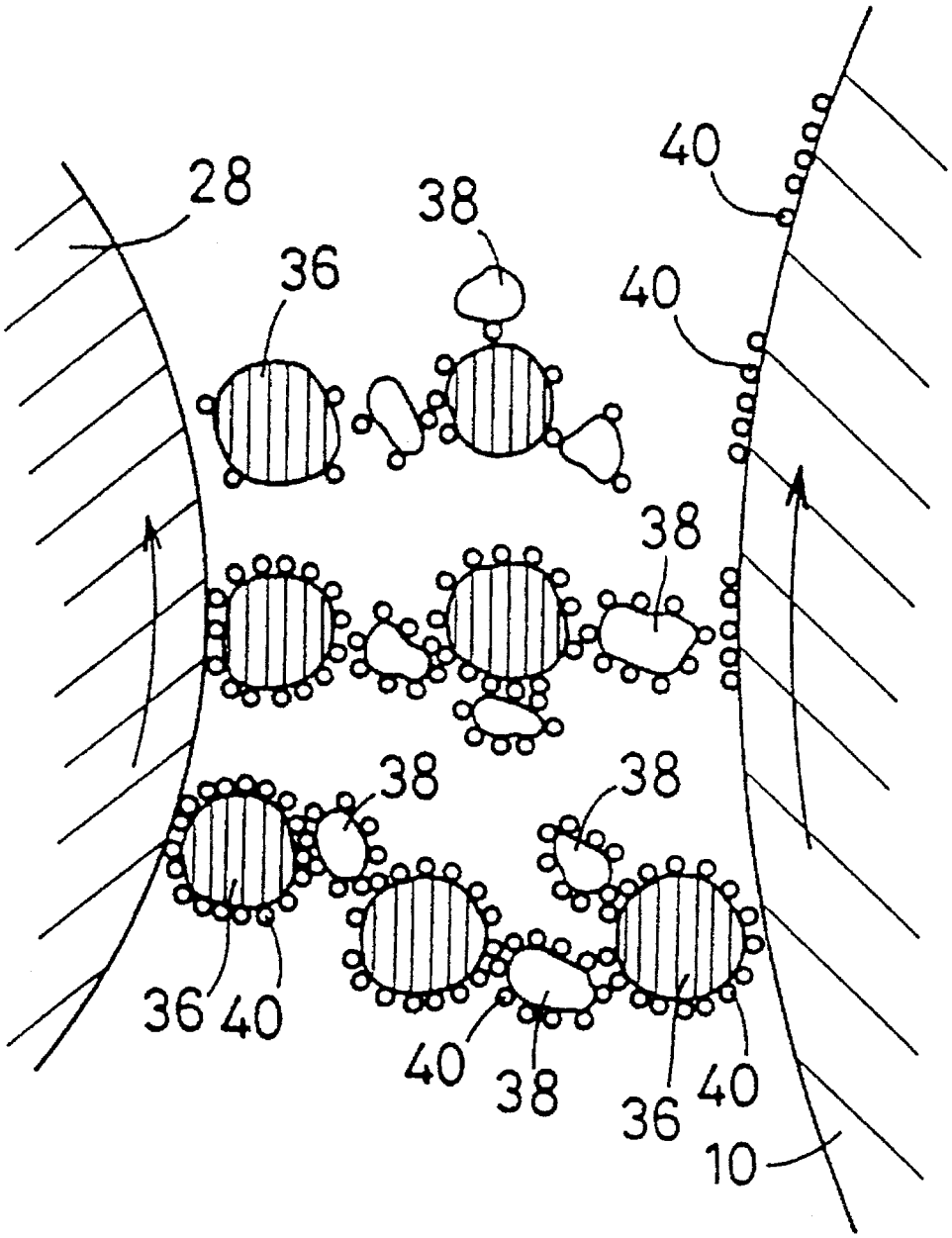
FIG. 2 is a schematic enlarged view illustrating a development condition between a developing sleeve and a photosensitive member in the laser beam printer shown in FIG. 1.

As mentioned above, the developer 30 carried by the developing sleeve 28 in the developing unit 16 forms a developer layer having a predetermined thickness on the surface of the developing sleeve 28. The developer layer comes into contact with the photosensitive member 10, and only the toner in the developer layer is deposited to the electrostatic latent image formed on the photosensitive member 10, thereby developing the electrostatic latent image. This condition is shown as an enlarged view in FIG. 2. Referring to FIG. 2, reference numerals 36, 38, and 40 denote the carrier, the electric field adjusting agent, and the toner, respectively. After development of the electrostatic latent image, the carrier 36, the electric field adjusting agent 38, the excess 38 toner 40, etc. which have not been used for the development are carried by the developing sleeve 28 to be restored into the carrier confining chamber 32, in which the developer 30 thus restored is reused for triboelectric charging of the toner 40. The electrostatic latent image on the photosensitive member 10 is formed by exposing a portion of the surface of the photosensitive member 10 to the light beam from the laser scanner 14 to thereby reduce a surface potential of 700 V applied from the charging unit 12 to the photosensitive member 10 down to a surface potential of, for example, 100 V at this exposed portion. On the other hand, a potential of, for example, 600 V as a bias potential is applied to the developing sleeve 28. Accordingly, the toner 40 positively charged is deposited to the exposed portion of the surface of the photosensitive member 10 at the potential of 100 V where the electrostatic latent image is formed, thus developing the electrostatic latent image with the toner 40. Although the chargeability of the toner 40 is herein set positively chargeable, it may also be set negatively chargeable. In this case, it is only necessary to reverse the polarity of the potential to be applied to each element.

A developed image of the toner 40 formed on the photosensitive member 10 in the above-mentioned manner is transferred onto the recording medium 18 such as a sheet of paper by means of the transferring unit 20. Thereafter, the toner 40 on the recording medium 18 is fixed by the heat fixing device 24, thereby recording an intended visual image on the recording medium 18.

In the development operation mentioned above, the electrostatic latent image developer 30 according to the present invention is preliminarily stored in the carrier confining chamber 32 of the developing unit 16. Owing to the mixing of the electric field adjusting agent 38 in the developer 30, the intensity of an electric field to be formed between the developing sleeve 28 and the photosensitive member 10 can be effectively enhanced to thereby uniform the amount of charges on the toner 40. Accordingly, the electrostatic latent image formed on the photosensitive member 10 can be faithfully developed by the toner 40, thereby forming a good developed image of the toner 40 on the photosensitive member 10.

EXAMPLES

There will now be described some specific examples embodying the present invention for the purpose of further understanding of the present invention. Furthermore, it is also to be understood that various changes, modifications, and improvements other than the description of the following examples and the aforementioned description may be made in a manner obvious to those skilled in the art without departing from the spirit and scope of the invention. Further, all parts and percentages mentioned in the following examples mean those by weight unless otherwise specified.

EXAMPLE 1

First, three kinds of carriers A, B, and C specified below are prepared.

Carrier A: polyethylene coated ferrite having an average particle size of 70 μm (made by Idemitsu Kosan Co., Ltd.)

Carrier B: resin uncoated magnetite having an average particle size of 40 μm (made by Powdertech Co., Ltd.)

Carrier C: silicone resin coated magnetite having an average particle size of 43 μm (made by Powdertech Co., Ltd.)

On the other hand, six kinds of electric field adjusting agents a, b, c, d, e, and f as shown in Table 1 are prepared. Specifically, the resin, magnetic powder, releasing agent, and charge control agent as the components of each electric field adjusting agent specified in Table 1 are weighed out, and are mixed together by using a mixer. Then, the mixture thus obtained is melted and kneaded to form a mixed bulk of each electric field adjusting agent. Then, the mixed bulk is coarsely ground to a size of about 1 to 2 mm, and are then finely ground. Then, the mixed bulk thus ground is classified to obtain each of the electric field adjusting agents a to f having the average particle sizes shown in Table 1. Each of the electric field adjusting agents a to f further contains 0.3 part of hydrophobic silica (RA made by Nippon Aerosil Corp.) as a fluidity improving agent per 100 parts of each electric field adjusting agent by mixing the hydrophobic silica into the adjusting agent and agitating them together by means of a mixer. Further, in the electric field adjusting agents c, d, and f, BL-50 specified in Table 1 is used as the magnetic powder.

TABLE 1

| | Electric Field Adjusting Agent | | | | | |
|---|---|---|---|---|---|---|
| Mixing Ratio (Parts) | a | b | c | d | e | f |
| Resin (UNI3000) | 15 | 25 | 30 | 20 | 40 | 45 |
| Magnetic Powder (EPT1000 or BL-50) | 80 | 70 | 70 | 80 | 55 | 50 |
| Releasing Agent (TP-32) | 5 | 5 | | | 5 | 5 |
| Charge Control Agent (N-01) | 2 | 2 | | 2 | 2 | 2 |
| Average Particle Size (μm) | 10 | 15 | 9.2 | 8.5 | 9.2 | 8.9 |

UNI3000: Styrene-Acrylic Resin Made by SANYO CHEMICAL INDUSTRIES, LTD.
EPT1000: Magnetite Made by TODA KOGYO CORP.
BL-50: Magnetite Made by Titan Kogyo Kabushiki Kaisha
TP-32: Polypropylene Made by SANYO CHEMICAL INDUSTRIES INC.
N-01: Nigrosine Dye Made by Orient Chemical Co., Ltd.

As similar to the electric field adjusting agent, three kinds of toners X, Y, and Z each having an average particle size of about 8 μm are prepared by using the resin, magnetic powder, releasing agent, and charge control agent specified in Table 2. Added to each toner thus prepared is 0.5 part of hydrophobic silica (RA200H made by Nippon Aerosil Corp.) as a fluidity improving agent per 100 parts of each toner, and the mixture of each toner and the silica is agitated by a mixer.

TABLE 2

| | Toner X | | Toner Y | | Toner Z | |
|---|---|---|---|---|---|---|
| | Kind | Mixing Ratio (Parts) | Kind | Mixing Ratio (Parts) | Kind | Mixing Ratio (Parts) |
| Resin | UNI3000 | 50 | TIZ 244 | 45 | TB 2000 | 50 |
| Magnetic Powder | EPT1000 | 45 | EPT1000 | 50 | EPT1000 | 45 |
| Releasing Agent | TP-32 | 5 | TP-32 | 5 | TP-32 | 5 |
| Charge Control Agent | N-01 | 2 | N-01 | 2 | N-01 | 2 |

TIZ 244: Styrene-Acrylic Resin Made by FUJIKURA KASEI CO., LTD.
TB 2000: Styrene-Acrylic Resin Made by SANYO CHEMICAL INDUSTRIES, LTD.

Then, the carriers A to C, the electric field adjusting agents a to f, and the toners X to Z are suitably combined to be mixed in the mixing ratios specified in Table 3 by using a tumbler mixer to obtain twelve samples I to XII of developer.

TABLE 3

| | Carrier | | Electric Field Adjusting Agent | | Toner | |
|---|---|---|---|---|---|---|
| Developer | Kind | Mixing Ratio (%) | Kind | Mixing Ratio (%) | Kind | Mixing Ratio (%) |
| I | A | 33 | a | 17 | X | 50 |
| II | — | — | a | 50 | X | 50 |
| III | A | 50 | — | — | Y | 50 |
| IV | — | — | — | — | X | 100 |
| V | — | — | b | 50 | X | 50 |
| VI | B | 50 | — | — | X | 50 |
| VII | C | 50 | — | — | X | 50 |
| VIII | A | 33 | a | 17 | Y | 50 |
| IX | C | 50 | c | 33 | Z | 17 |
| X | C | 50 | d | 33 | Z | 17 |
| XI | C | 50 | e | 33 | Z | 17 |
| XII | C | 50 | f | 33 | Z | 17 |

Each sample of the developer is supplied into the carrier confining chamber 32 of the laser beam printer shown in FIG. 1, and only the toner contained in each sample of the developer is charged into the toner box 50 of the laser beam printer. In this condition, development of the electrostatic latent image formed on the photosensitive member 10 is performed to obtain a toner image on the photosensitive member 10, and the toner image is transferred onto the recording medium 18 and then fixed thereon, thus obtaining a printed image. The printed image formed on the recording medium 18 is evaluated for density, fog, and interline splash rate. The results of evaluation are shown in Table 4.

The evaluation of the density, fog, and interline splash rate of the printed image is performed by the following methods.

Measurement of Density

A transmission density at a solid area of each printed sample is measured by using a Macbeth densitometer (TD-904 made by Macbeth K. K.). A value of −logT is calculated from a transmittance T of light. The smaller this value, the larger the density of the printed image. A diameter of a circular area to be subjected to the measurement of the transmission density is set to 5 mm. Accordingly, the measurement can be performed at a minimum solid area sized about 5 mm square.

Measurement of Fog

A whiteness W of each printed sample is measured by using a Suga Shikenki spectrophotometric colorimeter. The whiteness W is calculated from the following expression.

$$W=100-[(100-L)^2+a^2+b^2]$$

where L, a, and b can be obtained from measurement in the Lab color system with a C-source.

The whiteness W can be determined from a circular area having a diameter of 30 mm. In this test, a difference between the whiteness W of a back surface of each printed sample and the whiteness W of a nonprinted area of a front surface (printed surface) of each printed sample is evaluated. The smaller the difference, the less the fog that has occurred.

Measurement of Interline Splash Rate

A rate of splash of the toner present between lines printed is measured by using a PIAS image processing device. Specifically, of a printed pattern formed by lines with three spaces per dot, a nonprinted area between a group of three lines and another group of three lines is input as image data, and is binarized at a threshold level density to obtain a form of data that can be used for analysis. This data is processed to thereby calculate the rate of splash of the toner present between lines. The larger the splash rate, the more the clearness of letters or lines are reduced.

TABLE 4

| | Image Quality Characteristics | | |
|---|---|---|---|
| Developer | Density | Fog | Interline Splash Rate (%) |
| I | 2.51 | 0.28 | 8.94 |
| II | 2.14 | 0.27 | 26.5 |
| III | 2.31 | 0.34 | 15.7 |
| IV | 1.68 | 0.42 | 19.0 |
| V | 1.85 | 0.26 | 14.2 |
| VI | 1.89 | 0.61 | 10.5 |
| VII | 1.94 | 0.15 | 13.2 |
| VIII | 1.96 | 0.32 | 10.0 |
| IX | 2.11 | 0.33 | 7.4 |
| X | 1.99 | 0.25 | 8.2 |
| XI | 1.89 | 0.56 | 6.8 |
| XII | 1.77 | 0.89 | 7.7 |

As apparent from Table 4, the printed image obtained by using each of the samples I, VIII, IX, and X of the developer according to the present invention shows a sufficient density, less fog, and low interline splash rate, thus improving the clearness of letters or lines. To the contrary, the printed image obtained by using each of the samples II to VII of the developer, which samples do not contain the electric field adjusting agent and/or the carrier shows a high interline splash rate, which suggests the inferiority in clearness of letters or lines. Further, some of the samples II to VII show significant fog. Additionally, the printed image obtained by using each of the samples XI and XII of the developer containing a relatively small amount of magnetic powder in the electric field adjusting agent shows a low interline splash rate, which suggests the improvements in sharpness of lines and clearness of letters, but shows much fog in a white area.

EXAMPLE 2

In this example, the electric field adjusting agent containing a conductive material will be discussed. As similar to Example 1, all parts and percentages mentioned in the following example means those by weight unless otherwise specified.

First, two kinds of carriers (CR) specified below are prepared.

A: silicone coated ferrite carrier

B: silicone coated magnetite carrier

Both carriers A and B are those made by Powdertech Co. Ltd. and each has an average particle size of 50 μm.

Further, three kinds of electric field adjusting agents (FAP) having the compositions 1, 2, and 3 specified in Table 5 are prepared. Specifically, the component materials of each electric field adjusting agent (FAP) are mixed by using a mixer and the mixture is melted and kneaded to form a mixed bulk. Then, the mixed bulk is coarsely ground to a size of about 1 to 2 mm, and then finely ground. Then, the mixed bulk thus ground is classified to form a raw electric field adjusting agent having an average particle size of 9 μm. Then, 0.1 part of hydrophobic silica is mixed with 100 parts of the raw electric field adjusting agent, and the mixture thus obtained is agitated to disperse the silica on the surface of the raw electric field adjusting agent, thus obtaining each electric field adjusting agent (FAP).

In the composition 1, the electric field adjusting agent (FAP) having a volume resistivity of $3\times10^8$ Ωcm and a magnetic flux density of 60 emu/g is obtained. In the composition 2, the electric field adjusting agent (FAP) having a volume resistivity of $2\times10^7$ Ωcm and a magnetic flux density of 45 emu/g is obtained.

As a comparison, the electric field adjusting agent (FAP) having the composition 3 is prepared by adding carbon black as a conductive material to the composition 2. In the composition 3, the electric field adjusting agent (FAP) having a volume resistivity of $6\times10^{10}$ Ωcm is obtained.

TABLE 5

| | Electric Field Adjusting Agent (FAP) | | |
|---|---|---|---|
| Mixing Ratio (Parts) | Composition 1 | Composition 2 | Composition 3 |
| Resin (UNI3000) | 30 | 40 | 40 |
| Magnetic Powder (EPT1000) | 70 | 60 | 60 |
| Charge Control Agent (S-34) | 2 | — | — |
| Conductive Material (Carbon Black) | — | 10 | — |

UNI3000: Styrene-Acrylic Resin Made by SANYO CHEMICAL INDUSTRIES, LTD.
EPT1000: Magnetite Made by TODA KOGYO CORP.
S-34: Metal Complex of Azo Dye Made by Orient Chemical Co., Ltd.
CARBON BLACK: Made by Mitsubishi Kasei Corporation Further, a toner (TN) having the composition specified in Table 6 is prepared by mixing the component materials of the toner (TN) by a mixer, melting and kneading the mixture thus obtained to form a mixed bulk, coarsely grinding the mixed bulk to a size of about 1 to 2 mm, finely grinding the coarse grain thus obtained, and classifying the fine grain thus obtained to thereby form a raw toner having an average particle size of 9 μm. Then, 0.5 parts of hydrophobic silica is mixed with 100 parts of the raw toner, and the mixture thus obtained is agitated to disperse the silica on the surface of the raw toner, thus obtaining the toner (TN).

TABLE 6

| Mixing Ratio (Parts) | Toner |
|---|---|
| Resin (UNI3000) | 50 |
| Magnetic Powder (EPT1000) | 45 |
| Releasing Agent (TP-32) | 5 |
| Charge Control Agent (N-01) | 2 |

UNI3000: Styrene-Acrylic Resin Made by SANYO CHEMICAL INDUSTRIES, LTD.
EPT1000: Magnetic Powder Made by TODA KOGYO CORP.
TP-32: Polypropylene Made by SANYO CHEMICAL INDUSTRIES LTD.
N-01: Nigrosine Dye Made by Orient Chemical Co., Ltd.

Then, the carriers (CR) A and B, the electric field adjusting agents (FAP) having the compositions 1 to 3, and the toner (TN) are suitably combined to be mixed in the mixing ratios specified in Table 7 by using a tumbler mixer to obtain six samples (Sample Nos. 1 to 4 according to the present invention and sample Nos. 5 and 6 as a comparison) of developer.

Each sample of the developer is supplied into the carrier confining chamber 32 of the laser beam printer shown in FIG. 1, and only the toner (TN) contained in each sample of the developer is charged into the toner box 50 of the laser beam printer. In this condition, development of the electrostatic latent image formed on the photosensitive member 10 is performed to obtain a toner image on the photosensitive member 10, and the toner image is transferred onto the recording medium 18 and then fixed thereon, thus obtaining a printed image. The printed image formed on the recording medium 18 is evaluated in density, fog, and interline splash rate. The evaluation results are shown in Table 7. The methods of the evaluation of these characteristics are similar to those mentioned in Example 1.

TABLE 7

| | Developer Compositions | | | | | | Image Quality Characteristics | | |
|---|---|---|---|---|---|---|---|---|---|
| | CR | | FAP | | TN | | Density | Fog | Interline Splash Rate |
| Present Invention 1 | A | 50% | 1 | 25% | 25% | | 1.95 | 0.34 | 12.3% |
| Present Invention 2 | A | 28% | 1 | 28% | 44% | | 2.07 | 0.44 | 10.2% |
| Present Invention 3 | A | 20% | 2 | 60% | 20% | | 2.11 | 0.23 | 8.3% |
| Present Invention 4 | B | 70% | 2 | 10% | 20% | | 2.09 | 0.14 | 11.5% |
| Comparison 5 | A | 50% | 3 | 25% | 25% | | 2.04 | 0.67 | 18.3% |
| Comparison 6 | B | 20% | 3 | 60% | 20% | | 1.78 | 1.22 | 13.3% |

As apparent from Table 7, the printed image obtained by using each of the sample Nos. 1 to 4 of the developer according to the present invention shows a sufficient density, less fog, and low interline splash rate, thus improving the clearness of letters or lines. To the contrary, the printed image obtained by using each of the sample Nos. 5 and 6 as the comparison containing the electric field adjusting agent (FAP) of the composition 3 having a high volume resistivity shows a high interline splash rate, which suggests inferiority in clearness of letters or lines.

What is claimed is:

1. An electrostatic latent image developer comprising:

10 to 80 wt % of a carrier containing at least a magnetic powder;

10 to 55 wt % of a toner containing a binder resin and 35 to 55 wt % of said toner of a magnetic powder; and 5 to 60 wt % of an electric field adjusting agent containing at least 60 to 85 wt % of said electric field adjusting agent of a magnetic powder and 15 to 40 wt % of said electric field adjusting agent of a binder resin, wherein an average particle size of said electric field adjusting agent is smaller than an average particle size of said carrier, and wherein a content of said magnetic powder in said electric field adjusting agent is less than a content of said magnetic powder in said carrier and greater than a content of said magnetic powder in said toner.

2. The electrostatic latent image developer according to claim 1, wherein said developer contains 50 to 80 wt % of said carrier, 10 to 40 wt % of said toner, and 5 to 40 wt % of said electric field adjusting agent.

3. The electrostatic latent image developer according to claim 1, wherein said average particle size of said carrier is within a range of 20 to 100 μm.

4. The electrostatic latent image developer according to claim 3, wherein said average particle size of said carrier is within a range of 40 to 60 μm.

5. The electrostatic latent image developer according to claim 1, wherein said average particle size of said toner is within a range of 5 to 15 μm.

6. The electrostatic latent image developer according to claim 1, wherein said average particle size of said electric field adjusting agent is within a range of 5 to 30 μm.

7. The electrostatic latent image developer according to claim 6, wherein said average particle size of said carrier is within a range of 8 to 15 μm.

8. The electrostatic latent image developer according to claim 1, wherein said electric field adjusting agent further contains a releasing agent and a charge control agent.

9. The electrostatic latent image developer according to claim 1, wherein said electric field adjusting agent has a volume resistivity of $8\times10^8$ Ωcm or less.

10. The electrostatic latent image developer according to claim 9, wherein said electric field adjusting agent further contains a conductive material.

11. An electrostatic latent image developing device comprising:

a photosensitive member having a conductive cylinder and a photoconductive layer formed on said conductive cylinder;

a charging unit for providing a surface potential onto said photosensitive member;

a scanning unit for providing image information onto said photosensitive member to form an electrostatic latent image on said photosensitive member;

a developing unit for developing said electrostatic latent image formed on said photosensitive member by using a developer comprising 10 to 80 wt % of a carrier containing at least a magnetic powder; 10 to 55 wt % of a toner containing a binder resin and 35 to 55 wt % of said toner of a magnetic powder; and 5 to 60 wt % of an electric field adjusting agent containing at least 60 to 85 wt % of said electric field adjusting agent of a magnetic powder and 15 to 40 wt % of said electric field adjusting agent of a binder resin, wherein an average particle size of said electric field adjusting agent is smaller than an average particle size of said carrier, and wherein a content of said magnetic powder in said electric field adjusting agent is less than a content of said magnetic powder in said carrier and greater than a content of said magnetic powder in said toner;

a supplying unit for supplying at least said toner to said developing unit; and a transferring unit for transferring a developed image formed on said photosensitive member by said developer onto a recording medium.

12. The electrostatic latent image developing device according to claim 11, wherein said developing unit comprises a developer storing chamber for storing said developer, agitating means for agitating said developer stored in said developer storing chamber, and carrying means for carrying said developer stored in said developer storing chamber to said photosensitive member.

13. The electrostatic latent image developing device according to claim 11, wherein said average particle size of said carrier is within a range of 20 to 100 μm; an average particle size of said toner is within a range of 5 to 15 μm; and said average particle size of said electric field adjusting agent is within a range of 5 to 30 μm.

14. The electrostatic latent image developing device according to claim 11, wherein said supplying unit supplies said toner and said electric field adjusting agent to said developing unit.

15. The electrostatic latent image developing device according to claim 11, further comprising a cleaning unit for removing an excess part of said developer that has not been transferred by said transferring unit and is left on said photosensitive member.

16. The electrostatic latent image developing device according to claim 11, further comprising a heat fuser for heating and melting said developed image transferred onto said recording medium to thereby fix said developed image.

17. The electrostatic latent image developer according to claim 1, wherein said toner further contains a releasing agent and a charge control agent.

18. The electrostatic latent image developer according to claim 1, wherein a part of said magnetic powder contained in said electric field adjusting agent is deposited on surfaces of particles of said electric field adjusting agent so as to substantially cover said surfaces of said particles.

19. The electrostatic latent image developing device according to claim 11, wherein conductive cylinder is aluminum.

20. The electrostatic latent image developing device according to claim 11, wherein said scanning unit is a laser scanner.

21. The electrostatic latent image developer according to claim 11, wherein said toner further contains a releasing agent and a charge control agent.

22. The electrostatic latent image developer according to claim 11, wherein a part of said magnetic powder contained in said electric field adjusting agent is deposited on surfaces of particles of said electric field adjusting agent so as to substantially cover said surfaces of said particles.

23. The electrostatic latent image developing device according to claim 11, wherein said supplying unit supplies said toner to said developing unit according to consumption of said toner contained in said developer in concert with proceeding of development by said developing unit.

* * * * *